US006257915B1

(12) United States Patent
Endo

(10) Patent No.: US 6,257,915 B1
(45) Date of Patent: Jul. 10, 2001

(54) HALF-FITTING PREVENTION CONNECTOR

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/696,009

(22) Filed: Oct. 26, 2000

(30) Foreign Application Priority Data

Oct. 26, 1999 (JP) ..... 11-304267

(51) Int. Cl.[7] ..... H01R 13/627
(52) U.S. Cl. ..... 439/357; 439/352
(58) Field of Search ..... 439/350–358

(56) References Cited

U.S. PATENT DOCUMENTS

| | | | | |
|---|---|---|---|---|
| 5,749,747 | | 5/1998 | Inaba et al. | 439/358 |
| 5,820,399 | | 10/1998 | Shirouzu et al. | 439/352 |
| 5,820,400 | | 10/1998 | Yamanashi et al. | 439/358 |
| 5,848,912 | * | 12/1998 | Okabe | 439/489 |
| 5,919,056 | | 7/1999 | Suzuki et al. | 439/352 |
| 5,938,470 | | 8/1999 | Kashiyama | 439/489 |
| 5,947,763 | * | 9/1999 | Alaksin | 439/489 |
| 6,059,597 | * | 5/2000 | Endo et al. | 439/352 |
| 6,065,991 | * | 5/2000 | Fukuda | 439/352 |
| 6,095,843 | * | 8/2000 | Kaneko et al. | 439/352 |
| 6,109,956 | * | 8/2000 | Kawase et al. | 439/489 |

FOREIGN PATENT DOCUMENTS

| | | |
|---|---|---|
| 9-180818 | 7/1997 | (JP) . |
| 9-180820 | 7/1997 | (JP) . |
| 9-185974 | 7/1997 | (JP) . |
| 10-50408 | 2/1998 | (JP) . |

OTHER PUBLICATIONS

Patent Abstract of Japan 10050408 Feb. 20, 1998.
Patent Abstract of Japan 09180818 Jul. 11, 1997.
Patent Abstract of Japan 09185974 Jul. 15, 1997.

* cited by examiner

*Primary Examiner*—Brian Sircus
*Assistant Examiner*—Son V. Nguyen
(74) *Attorney, Agent, or Firm*—Sughrue, Mion, Zinn, Macpeak & Seas, PLLC

(57) ABSTRACT

In a half-fitting prevention connector (1), a slider (31), which prevents a half-fitted condition, and has a retaining function, is received in a housing (4) of a first connector (2). A retaining portion (23) is formed on a housing (16) of a second connector (3). When the first and second connectors (2, 3) are fitted together, the retaining portion (23) abuts against an abutment portion (37) of the slider (31) to move the same, so that a spring portion (32) of the slider (31) produces a resilient force because of its own resiliency, thereby preventing a half-fitted condition. When the fitting operation is further continued, so that the two connectors are fitted together in the proper position, the retaining portion (23) on the second connector (3) is retainingly engaged with a bendable portion (36) of the slider (31), so that the two connectors are completely fitted together. For canceling the fitted condition of the first and second connectors (2, 3), a cancellation operating portion (11) is pressed to lift a retainment cancellation projection (11*c*) in a direction of arrow (P2), thereby disengaging the retaining portion (23) from the bendable portion (36), thus canceling the fitted condition.

2 Claims, 9 Drawing Sheets

HALF-FITTING PREVENTION CONNECTOR

BACKGROUND OF THE INVENTION

1. Field of the Invention

The present invention relates to a half-fitting prevention connector which is among those connectors, extensively used for connection to wire ends of a wire harness in an automobile, and is capable of detecting a half-fitted condition. More particularly, the present invention relates to such a half-fitting prevention connector provided with a resilient member for producing a force to move one of two connectors away from the other in a half-fitted condition.

The present application is based on Japanese Patent Application No. Hei. 11-304267, which is incorporated herein by reference.

2. Description of the Related Art

In recent years, various electronic equipments have been mounted on various automobiles, and various connectors have been extensively used for connecting such electronic equipments together and for connecting wire harnesses together. In a production process or at the time of maintenance, two connectors are fitted together to be electrically connected together. However, if the two connectors are not completely fitted together, the electrical connection therebetween is improper, and besides the two connectors thus fitted together are withdrawn or disengaged from each other. Therefore, there has heretofore been proposed a half-fitting prevention connector of the type in which the two connectors are retained relative to each other in a completely-fitted condition so as to prevent the two connectors from being easily disengaged from each other.

One example of conventional half-fitting prevention connectors will now be described with reference to FIGS. 9 and 10. This half-fitting prevention connector is of such a construction that a male connector (one connector) 51 and a mating female connector (the other connector) 52, when fitted together, are prevented from being kept in a half-fitted condition.

The male connector 51 includes a connector housing 53 which has terminal receiving chambers (each in the form of a through hole) for respectively receiving a predetermined number of female terminals 80, and also has terminal insertion ports open to the front side thereof. This male connector further includes an exclusive-use housing formed at an upper portion of the connector housing 53, and a slider 60, having a resilient member (not shown) is slidably mounted in this exclusive-use housing.

The female connector 52 includes a housing 71 which has terminal receiving chambers (each in the form of a through hole) for respectively receiving a predetermined number of male terminals, and also has terminal insertion ports open to the front side thereof. A pair of stopper projections 72 for abutting engagement with an abutment projection 64 on the slider 60 during the connector fitting operation are formed on an upper surface of the housing 71. A slanting projection 73, having a slanting surface for elastically deforming a lock arm 56, is formed between the stopper projections 72 and 72. An engagement groove 74, in which a housing lock 58 can be engaged, is provided at a rear end of the slanting projection 73.

FIG. 9 shows a completely-fitted condition of the male and female connectors 51 and 52. For canceling the fitted condition, the slider 60 is withdrawn in a direction of arrow F while pressing a pressing portion 65 of the slider 60 by the finger or the like. As a result, a slider arm 62 of the slider 60 slides over a slanting surface of a lock beak 57, and is elastically deformed upwardly as shown in FIG. 10. The abutting engagement of a displacement prevention projection, provided on the housing lock 58, with a displacement prevention portion of the slider 60 is canceled, so that the free end of the housing lock 58 can be displaced. Then, the disengaging force is caused to act between the two connectors, so that the housing lock 58 (formed at the distal end of the lock arm 56), retainingly engaged in the engagement groove 74, is elastically deformed upwardly, thus canceling the retained condition. In this condition, the body of the female connector 52, held with the hand, is withdrawn rearwardly, and by doing so, the female connector 52 can be easily withdrawn from the male connector 51.

In the above conventional connector, however, for canceling the fitted condition of the male and female connectors 51 and 52, it is necessary to move the slider 60 from the upper side and to disengage the housing lock 58 from the slanting projection 73. Therefore, there has been encountered a problem that the efficiency of the operation for canceling the fitted condition of the male and female connectors 51 and 52 can not be easily enhanced.

SUMMARY OF THE INVENTION

With the above problem in view, it is an object of the present invention to provide a half-fitting prevention connector in which two connectors, when fitted together, are prevented from being kept in a half-fitted condition, and besides a canceling operation can be carried out easily.

To achieve the above object, according to the first aspect of the present invention, there is provided a half-fitting prevention connector which comprises:

a pair of first and second connectors fittable to each other;

wherein the first connector includes:

a slider receivable in a slider receiving portion formed at an upper portion of a housing of the first connector, the slider comprising:

a resiliently-deformable bendable portion having an abutment portion formed at a distal end of the slider, and a contractible spring portion provided at a rear portion of the slider;

a push-up projection formed on an inner surface of the slider receiving portion so as to resiliently deform the bendable portion of the slider; and a cancellation operating portion which can be swingingly moved about one end of the housing so as to push up the push-up projection, wherein the second connector includes a retaining portion provided at one end of a housing of the second connector, wherein when the second connector is fitted relative to the first connector, the retaining portion abuts against the abutment portion of the slider to compress the slider, and wherein when the two connectors are completely fitted together, the retaining portion is engaged in a retaining hole formed in the bendable portion.

Further, according to the second aspect of the present invention, preferably, the slider includes a base plate, which is movable in accordance with the expansion and contraction of the spring portion, and has the retaining hole, and guide projections which are formed respectively on wall portions, formed respectively at opposite side edges of the base plate, so as to guide the movement of the base plate.

In the half-fitting prevention connector of the above construction, when the first and second connectors are fitted together, the abutment portion of the slider, received in the housing of the first connector, abuts against the retaining portion, formed on the housing of the second connector, in a half-fitted condition of the two connectors. The slider can be expanded and contracted because of its own resiliency, and therefore the slider, when pushed by the retaining portion, produces a resilient force tending to push the first connector back, and therefore a half-fitted condition of the first and second connectors can be positively detected.

When the fitting operation further proceeds, the spring portion of the slider is compressed by the retaining portion, and the base plate is displaced, and the bendable portion is resiliently deformed by the push-up projection, and slides past the retaining portion, so that the push-up projection and the retaining portion are engaged with each other in the retaining hole, thus achieving the completely-fitted condition.

For canceling the fitted condition, the free end of the cancellation operating portion is pressed down, so that the bendable portion is lifted and bent by the opposite end portion of the cancellation operating portion. In this condition, when the first and second connectors are moved away from each other, the retaining portion, engaged in the retaining hole, is disengaged therefrom, and therefore the first and second connectors can be easily disengaged from each other.

DETAILED DESCRIPTION OF THE PREFERRED EMBODIMENT

Figure 1:
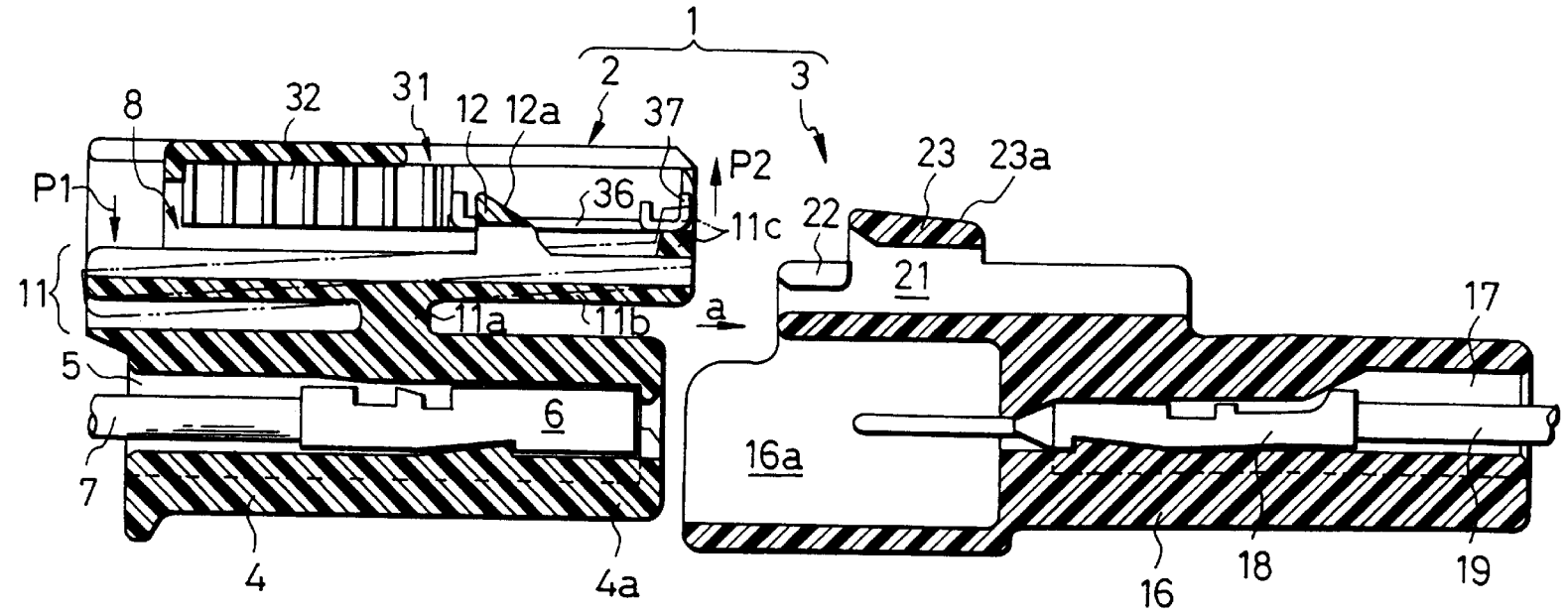
FIG. 1 is a vertical cross-sectional view showing one preferred embodiment of a half-fitting prevention connector of the present invention.
Figure 2:
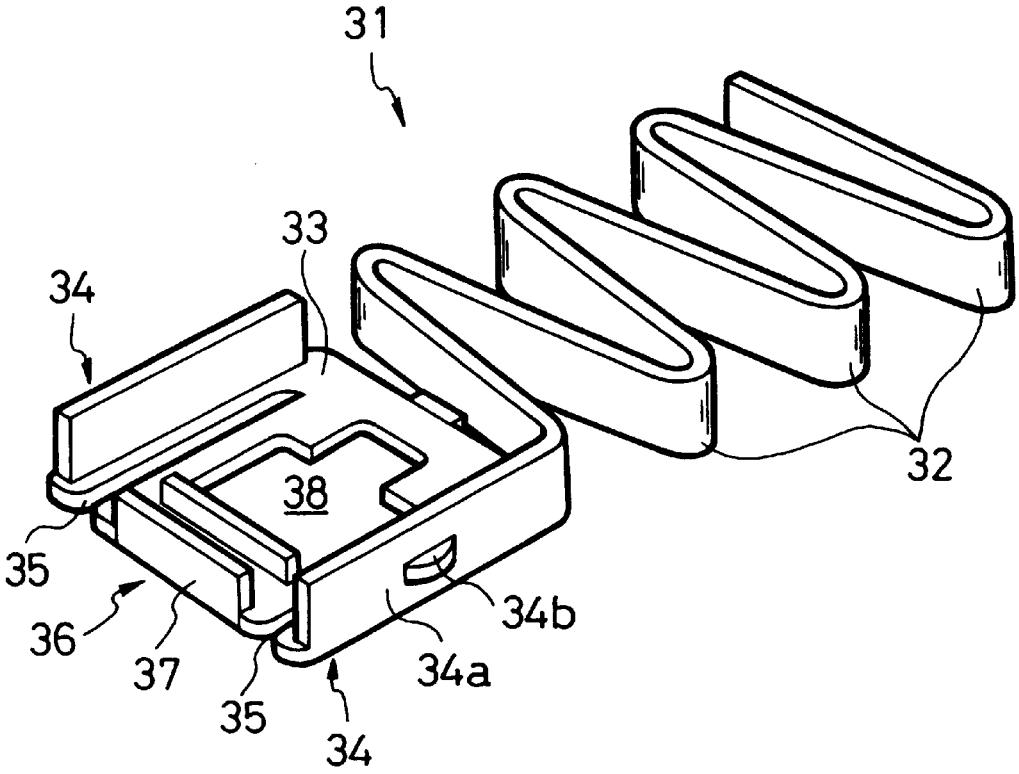
FIG. 2 is a perspective view showing the construction of a slider.
Figure 3:
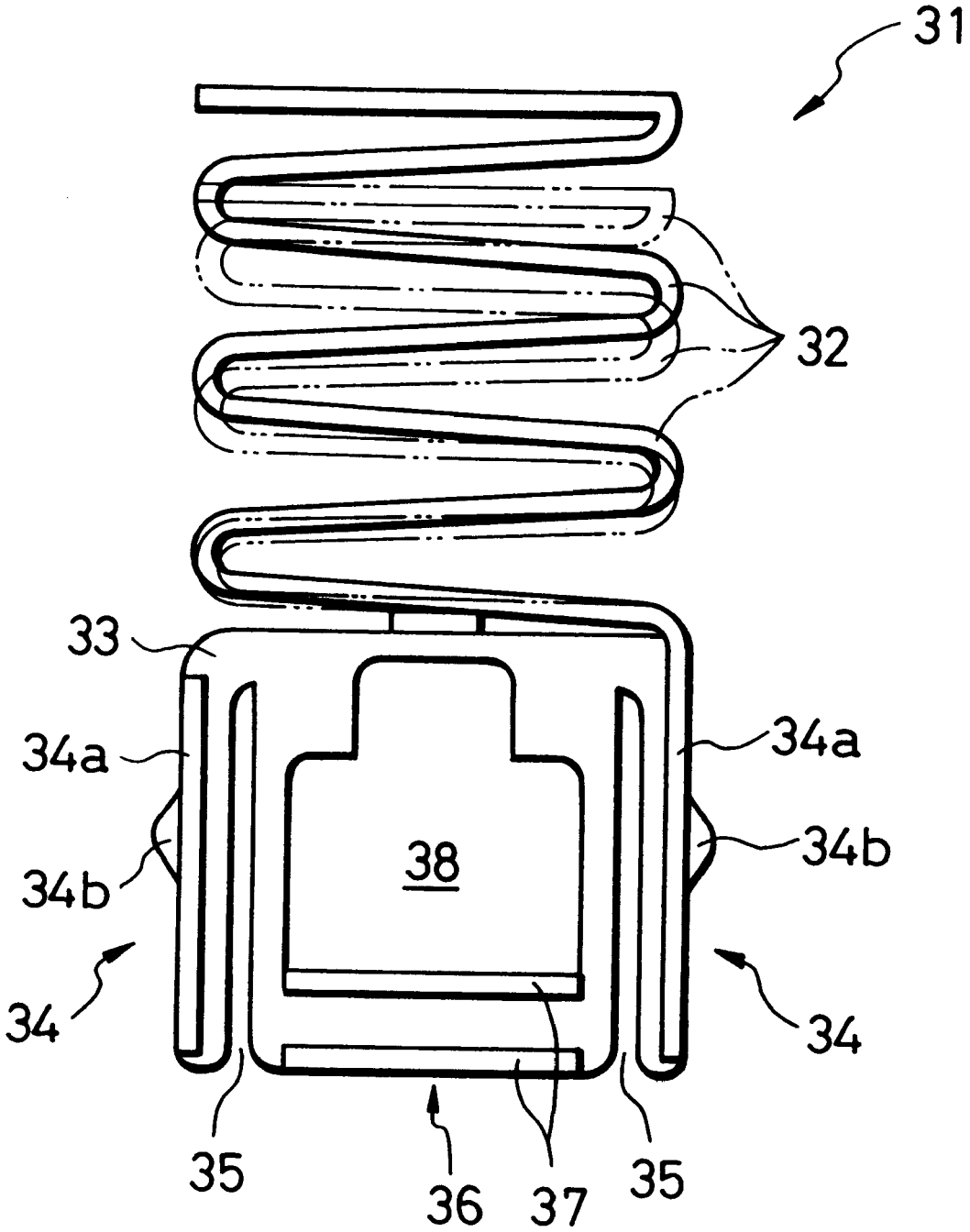
FIG. 3 is a plan view showing the slider of FIG. 2.
Figure 4:
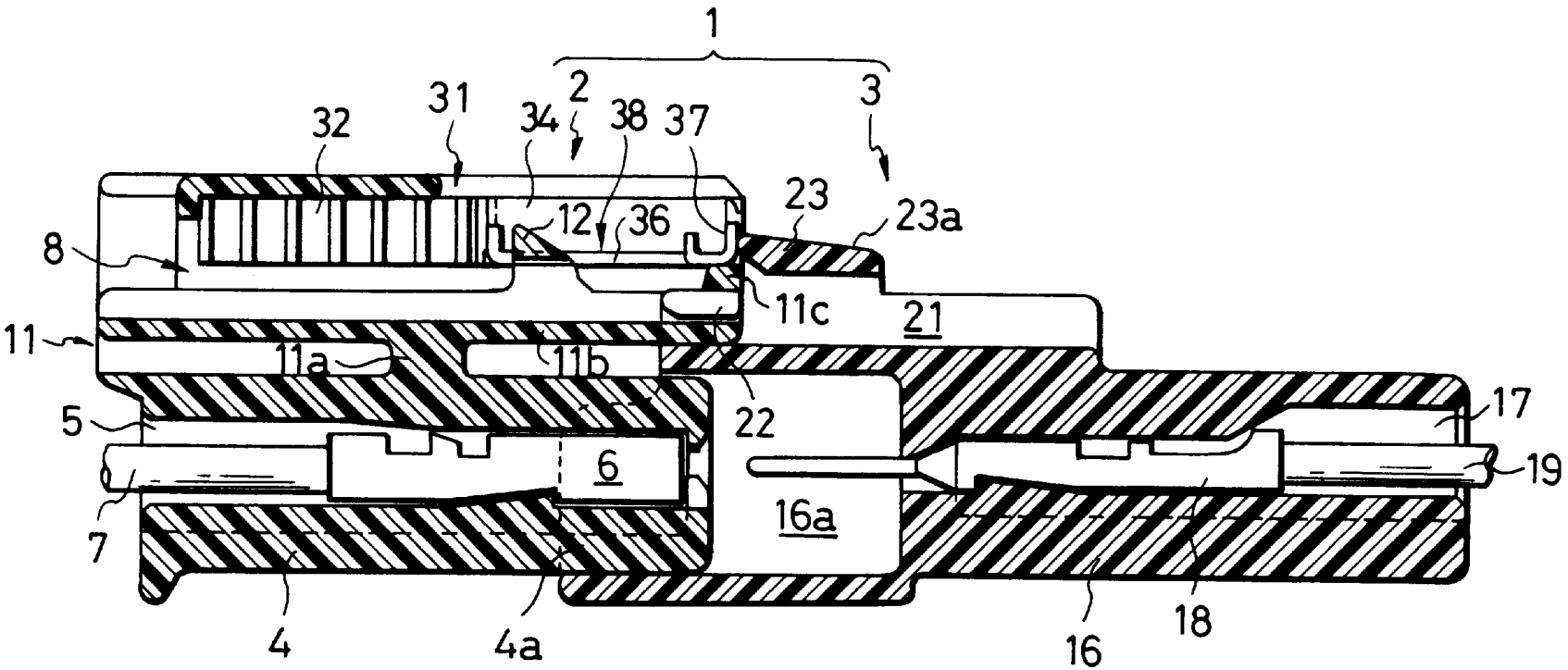
FIG. 4 is a view explanatory of an operation, showing an initial stage of a fitting connection between first and second connectors in FIG. 1.
Figure 5:
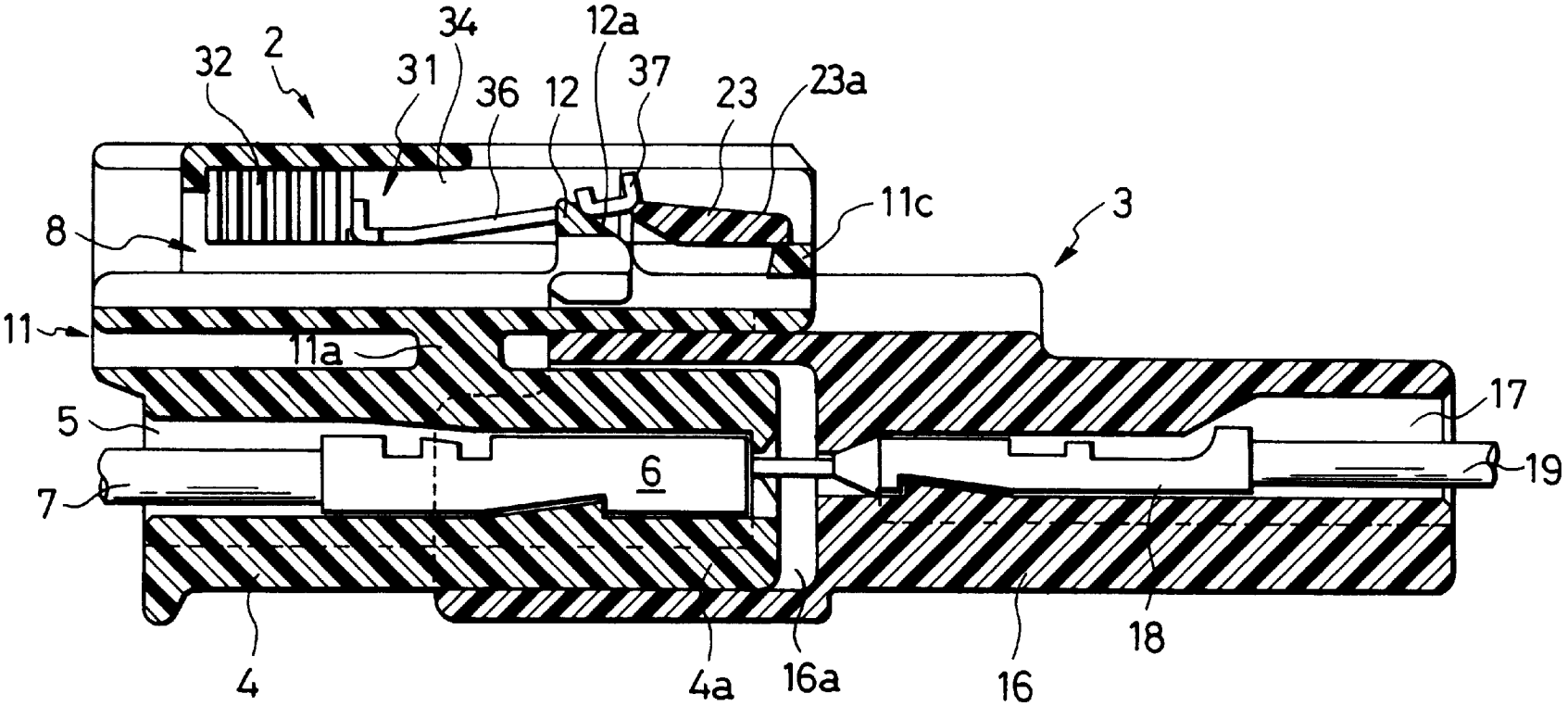
FIG. 5 is a view explanatory of the operation, showing a half-fitted condition of the connectors of FIG. 4.
Figure 6:
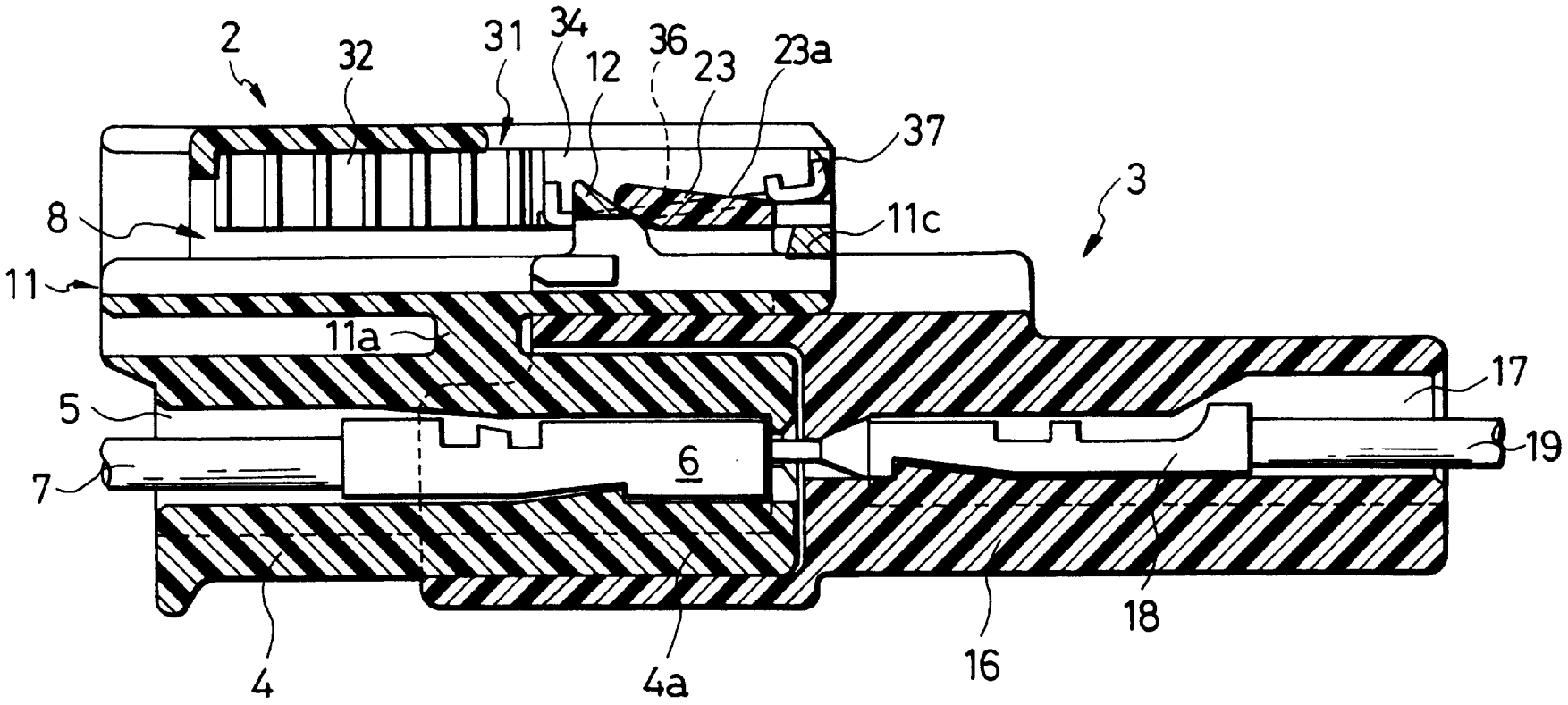
FIG. 6 is a view explanatory of the operation, showing a completely-fitted condition of the connectors of FIG. 5.
Figure 7:
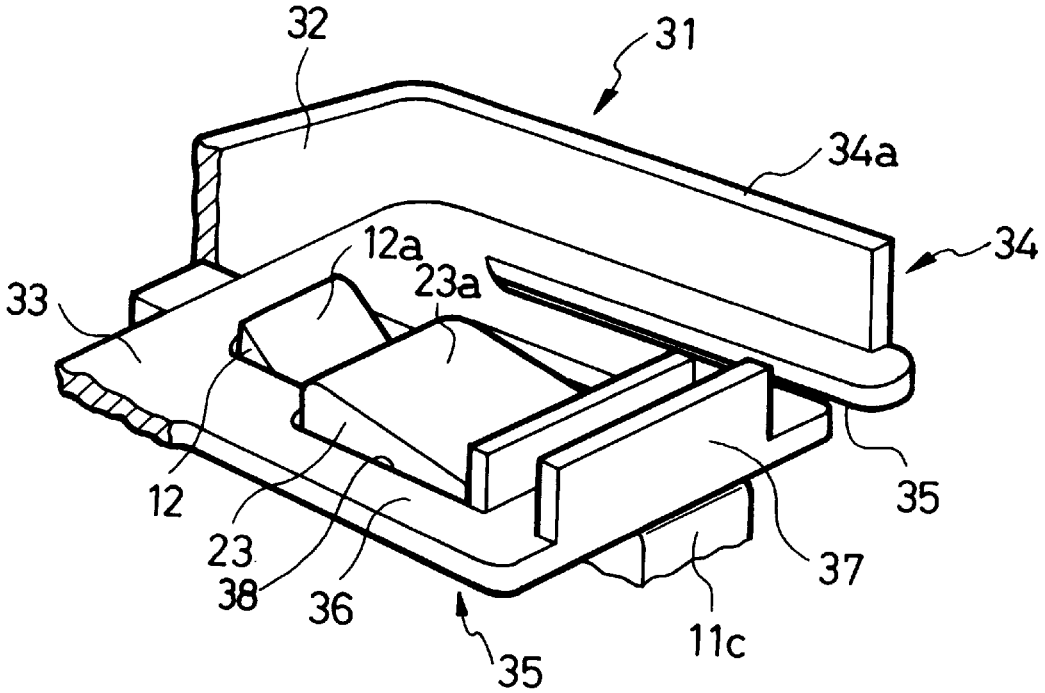
FIG. 7 is an enlarged fragmentary, perspective view showing the slider engaged with a push-up projection and a retaining portion.
Figure 8:
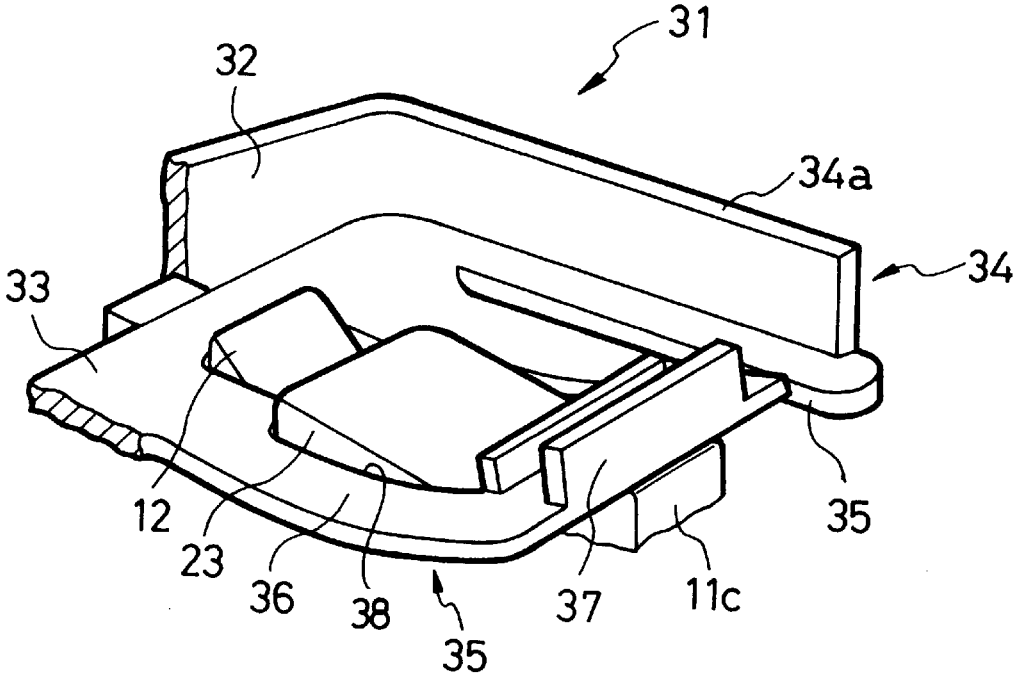
FIG. 8 is an enlarged fragmentary, perspective view showing a condition in which the retained condition is canceled by operating a cancellation operating portion.
Figure 9:
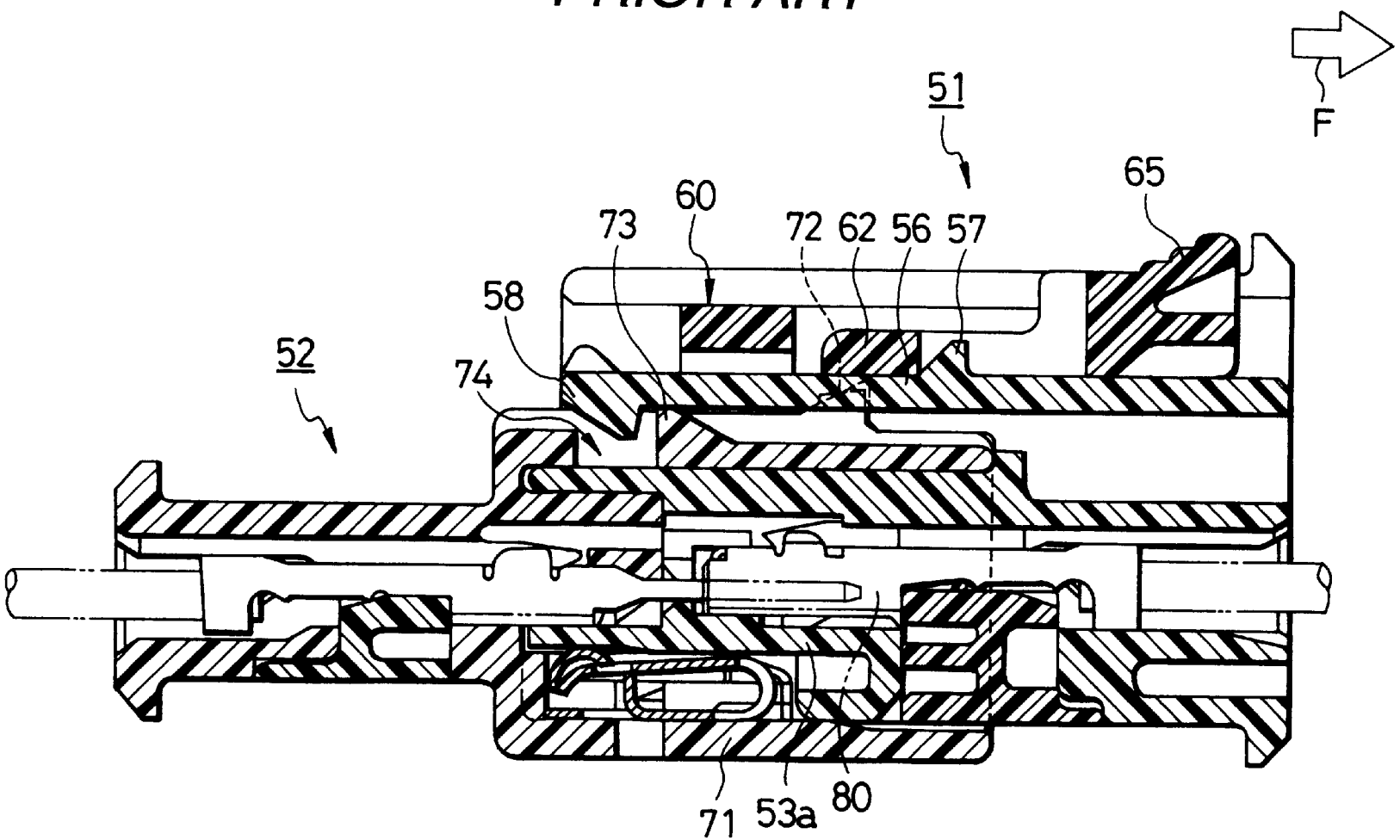
FIG. 9 PRIOR ART
FIG. 9 is a cross-sectional view showing a conventional half-fitting prevention connector in a completely-fitted condition.
Figure 10:
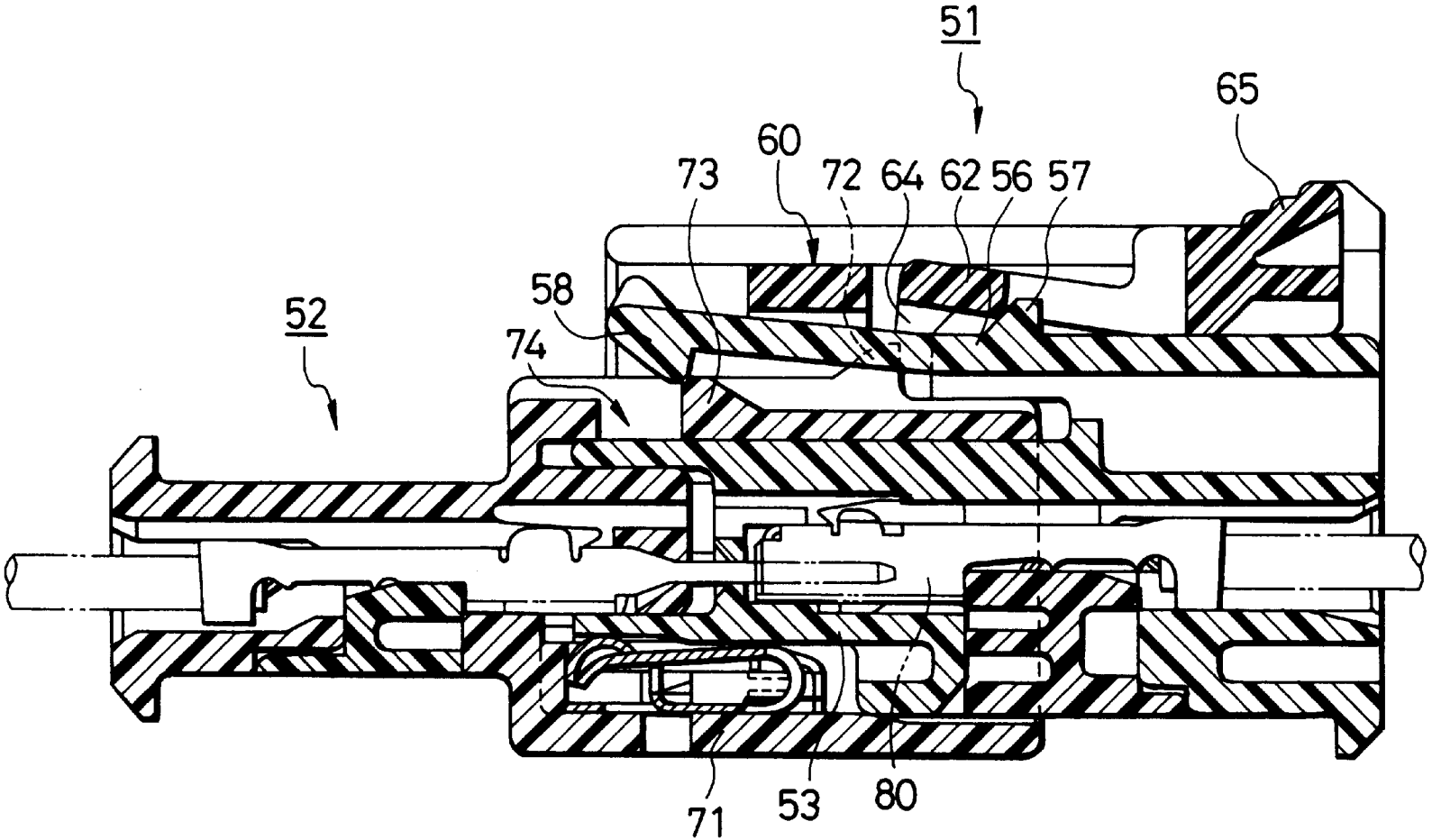
FIG. 10 PRIOR ART
FIG. 10 is a view explanatory of an operation, showing a condition in which a retained condition of the connector of FIG. 9 is canceled.

One preferred embodiment of a half-fitting prevention connector of the present invention will now be described with reference to FIGS. 1 to 8. FIG. 1 is a cross-sectional view showing the construction of a pair of male and female connectors to be fitted together, FIG. 2 is a perspective view showing the construction of a slider, FIG. 3 is a plan view showing the construction of the slider, FIGS. 4 to 6 are views explanatory of an operation for retaining the first and second connectors relative to each other, FIG. 7 is an enlarged fragmentary, perspective view showing the retaining operation by the slider, and FIG. 8 is an enlarged fragmentary, perspective view showing the retainment cancellation operation by the slider.

In the description of the embodiment, the construction of the first and second connectors, as well as the component members, will first be described, and then the retaining operation and the retainment cancellation operation will be described.

In the half fitting prevention connector 1 of this embodiment shown in FIG. 1, the first connector 2 and the second connector 3 are positively completely fitted together while preventing a half-fitted condition of the two connectors. The construction of this half-fitting prevention connector will be described below.

The first connector 2 includes a housing 4 having a fitting portion 4*a* formed at a lower portion thereof, and terminal receiving chambers 5 are formed in the fitting portion 4*a,* and connection terminals 6 of the female type, each press-connected to an end portion of a wire 7, are received in these terminal receiving chambers 5, respectively.

A slider receiving portion 8 is formed at an upper portion of the housing 4, and the slider 31 for preventing a half-fitted condition is received in this slider receiving portion 8. A cancellation operating portion 11 is provided between the lower portion of the housing 4 (at which the terminal receiving chambers 5 are formed) and the upper portion of this housing at which the slider receiving portion 8 is formed.

The cancellation operating portion 11 includes an interconnecting portion 11*a,* extending upright from the lower portion of the housing 4, a moving portion 11*b,* swingingly movable about the interconnecting portion 11 serving as a fulcrum, and a retainment cancellation projection 11*c* formed at a front end of the moving portion 11*b*. When the moving portion 11*b* is pressed in a direction of arrow P1 (FIG. 1) by the finger or the like, the moving portion 11*b* is moved like a seesaw about the interconnecting portion 11*a* as indicated in an imaginary line, so that the retainment cancellation projection 11*c* at the right end moves in a direction of arrow P2.

A push-up projection 12 for pushing up a bendable portion 36 (which is part of the slider 31) during the fitting operation is provided at the bottom of the slider receiving portion 8. The construction and operation of the push-up projection 12 and the bendable portion 36 will be described later in detail when describing the fitting operation of the first and second connectors 2 and 3.

Next, the construction of the second connector 3 will be described. Terminal receiving chambers 17 are formed in a lower portion of a housing 16, and connection terminals 18, each press-connected to a wire 19, are received in these terminal receiving chambers 17, respectively. A fitting hole 16*a* for fitting on the fitting portion 4*a* of the first connector 2 in the fitting operation is formed in a front end portion of the housing 16.

An insertion guide portion 21 for receiving the moving portion 11*b* of the first connector 2 in the fitting operation, a guide projection 22 for insertion into the housing 4 of the first connector 2, and a retaining portion 23 for preventing a half-fitted condition in cooperation with the slider 31 and for effecting the retaining operation, are formed on an upper portion of the housing 16.

Next, the slider 31 will be described with reference to FIGS. 2 and 3.

As shown in FIG. 2, the slider 31 functions to prevent a half-fitted condition when the first and second connectors 2 and 3 are fitted together, and also has the retaining function. This slider 31 of an integral construction is made of metal, and includes a spring portion 32, formed by bending a strip-like portion into a zigzag shape in a plane, guide portions 34 formed respectively at opposite side edges of a base plate 33 formed integrally with the spring portion 32, and the bendable portion 36 which is rendered resiliently deformable as a result of formation of slits 35 in the base plate 33. An abutment portion 37 is formed at a distal end of the bendable portion 36, and a retaining hole or opening 38 is formed through a central portion of the bendable portion 36.

The spring portion 32 can be deformed into a compressed condition as indicated in an imaginary line in FIG. 3, and can be restored into its original shape (as indicated in a solid line) because of its resiliency. The spring portion 32 has such a width that it can be fitted into the slider receiving portion 8.

The guide portions 34 respectively comprise a pair of wall portions 34*a* formed respectively at the opposite side edges of the base plate 33, and a guide projection 34*b* is formed on an outer surface of each of the two wall portions 34*a*.

The base plate 33 is reciprocally moved within the slider receiving portion 8 in accordance with the expansion and contraction of the spring portion 32, and in order to effect this reciprocal movement smoothly, the pair of wall portions 34*a* are formed upright at the opposite side edges of the base plate 33, respectively. One of the wall portions 34*a* is formed as an extension of the spring portion 32, and with this construction the base plate 33 is kept in a flat condition.

The guide projections 34*b* are formed respectively on the outer surfaces of the pair of wall portions 34*a* so as to enable the base plate 33 to be moved more smoothly. When the slider 31 is received in the slider receiving portion 8, the pair of guide projections 34*b* are fitted respectively in guide grooves (not shown) formed respectively in opposed inner side surfaces of the slider receiving portion 8.

With this construction, when the spring portion 32 is expanded and contracted, the whole of the base plate 33 is reciprocally moved smoothly, and only the bendable portion 36 is resiliently deformed about one end of the base plate 33.

The bendable portion 36 prevents a half-fitted condition during the connector fitting operation, and also retains the mating connector in a fitted condition. Although the bendable portion 36 reciprocally moves in unison with the base plate 33, this bendable portion 36 can be resiliently deformed independently of the base plate 33 because of the formation of the slits 35.

The abutment portion 37, formed at the distal end of the bendable portion 36, abuts against the retaining portion 23 of the mating connector during the connector fitting operation to compress the spring portion 32.

When the first and second connectors 2 and 3 are fitted together, the retaining hole 38 allows the push-up projection 12 and the retaining portion 23 to be engaged with each other so as to retain the first and second connectors 2 and 3 relative to each other.

Next, the fitting and retaining operations of the first and second connectors 2 and 3 will be described.

With respect to the first connector 2, the slider 31 is mounted in the slider receiving portion 8 formed at the housing 4, and the connection terminals 6 are inserted respectively into the terminal receiving chambers 5, as shown in FIG. 1. With respect to the second connector 3, the connection terminals 18 are inserted into the terminal receiving chambers 17, respectively. After each of the first and second connectors 2 and 3 is thus assembled, the two connectors 2 and 3 are arranged in opposed relation to each other, and then the first connector 2 is inserted into the second connector 3 in a direction of arrow a.

Then, the fitting portion 4*a* of the housing 4 of the first connector 2 is fitted into the fitting hole 16*a* in the second connector 3, and the retaining portion 23, formed at the upper portion of the second connector 3, abuts against the abutment portion 37 formed at the distal end of the slider 31, as shown in FIG. 4.

At this time, the guide projection 22 is inserted into the moving portion 11*b* while the moving portion 11*b* is inserted into the insertion guide portion 21. At this stage, the spring portion 32 of the slider 31 is kept in an expanded condition, and only the push-up projection 12 is inserted in the retaining hole 38.

Then, when the inserting operation further proceeds, the fitting portion 4*a* is inserted deep into the fitting hole 16*a,* so that the connection terminals 6 are connected to the connection terminals 18, respectively. At this time, the abutment portion 37 is pushed by the retaining portion 23, and the spring portion 32 is compressed, so that the whole of the base plate 33 is pushed into the slider receiving portion 8, and the abutment portion 37 slides over the push-up projection 12 since a slanting surface 12*a* is formed on the front side of the push-up projection 12. This operation can be carried out since the distal end portion of the bendable portion 36 can be resiliently deformable while the base plate 33 is not resiliently deformed because of the provision of the guide portions 34, so that the slider 31 can move smoothly.

In the condition shown in FIG. 5, when the fitting operation further proceeds, the abutment portion 37 further moves upward along the slanting surface 12*a,* so that the retaining portion 23 slides under the abutment portion 37. Then, when the fitting operation further proceeds as shown in FIG. 6, the abutment portion 37 slides onto the upper surface of the retaining portion 23, and therefore the pressing force, which has compressed the spring portion 32, is removed, so that the spring portion 32 is restored from the compressed condition into the expanded condition. Namely, a gently-slanting surface 23*a* is formed on the upper surface of the retaining portion 23, and therefore the abutment portion 37 is returned toward its initial position in accordance with the expansion of the spring portion 32.

When the abutment portion is returned to the rear end of the retaining portion 23, the bendable portion 36 is restored into the initial configuration because of its own resiliency, and therefore the push-up projection 12 and the retaining portion 23 are engaged with each other in the retaining hole 38, as shown in FIG. 7. In this condition, one end of the retaining hole 38 is retained by the push-up projection 12, and therefore the whole of the base plate 33 is retained against movement, and the retaining portion 23 is retained by one end of the retaining hole 38 in the base plate 33.

Therefore, the retaining portion 23 of the second connector 3 is retained by the first connector 2, and the first and second connectors 2 and 3 are connected together in a completely-fitted condition.

When the pushing of the first and second connectors 2 and 3 relative to each other is stopped at the stage of FIG. 5 or FIG. 6, erroneously judging that the fitting operation has been completed, the retaining portion 23 is pushed back as a result of expansion of the spring portion 32, so that the second connector 3 is pushed out of the first connector 2, and therefore this half-fitted condition can be detected.

Next, the operation for canceling the retained condition of the first and second connectors 2 and 3 in the completely-fitted condition will be described.

For canceling the retained condition of the first and second connectors 2 and 3, the moving portion 11*b* is pressed in the direction of arrow P1 (FIG. 1) by the finger or the like, so that the retainment cancellation projection 11*c* is lifted in the direction of arrow P2 together with the moving portion 11*b*. However, since the guide projections 34*b*, formed respectively on the outer surfaces of the guide portions 34, are engaged respectively in the guide grooves (not shown), formed in the housing 4, the base plate 33 is prevented from upward and downward movement.

Therefore, when the retainment cancellation projection 11*c* is lifted in the direction of arrow P2 as shown in FIG. 8, the front end of the bendable portion 36 is lifted, so that the retaining portion 23, formed on the second connector 3, is disengaged from the retaining hole 38. Therefore, by withdrawing the second connector 3 from the first connector 2 while pressing the moving portion 11*b* in the direction of arrow P1, the fitted condition of the first and second connectors 2 and 3 can be canceled, and the two connectors can be easily disengaged from each other.

As described above, in the half-fitting prevention connector 1 of this embodiment, the first and second connectors 2 and 3 are retained relative to each other by the slider 31 and the retaining portion 23, and the retained condition can be canceled positively and easily by the simple operation, that is, by pressing the cancellation operating portion 11. Therefore, a half-fitted condition can be prevented at the time of the production and the after-sale service, and besides the cancellation of the retained condition can be easily effected, and therefore the efficiency of the operation can be enhanced.

The retained condition can not be canceled unless the retaining portion 23 is disengaged from the retaining hole 38, and therefore the connection will not become improper during use even when the half-fitting prevention connector is employed in an automobile used in severe environments, and the reliability of an equipment or the like, using the half-fitting prevention connector, can be enhanced.

As described above, in the half-fitting prevention connector of the present invention, when the first and second connectors are to be fitted together, the abutment portion of the slider, received in the first connector, is pushed and moved by the retaining portion, formed on the second connector, so that the spring portion of the slider is compressed, and the bendable portion of the slider is resiliently deformed by the push-up projection, and the push-up projection and the retaining portion are engaged in the retaining hole formed in the slider, thereby effecting the fitting and retaining connection between the first and second connectors.

For canceling the fitted condition, the cancellation operating portion is operated to push up the bendable portion to bend the same, thereby disengaging retaining portion from the retaining hole, so that the retained condition of the first and second connectors is canceled, and the two connectors can be disengaged from each other.

Therefore, when the first and second connectors are fitted together, the abutment portion of the slider, received in the housing of the first connector, abuts against the retaining portion, formed on the housing of the second connector, in a half-fitted condition of the two connectors. The resilient force of the spring portion of the slider tends to push the second connector back so as to prevent a half-fitted condition, and therefore the defective condition due to such a half-fitted condition is prevented.

When the fitting operation is further continued, so that the two connectors are fitted together in the proper position, the retaining portion is retainingly engaged in the retaining hole formed in the slider, so that the first and second connectors are retained relative to each other in the completely-fitted condition. Therefore, there can be obtained the half-fitting prevention connector of high reliability.

The cancellation of the retained condition can be easily effected by operating the cancellation operating portion provided at the first connector, and therefore the efficiency of the operation at the time of maintenance can be enhanced.

What is claimed is:

1. A half-fitting prevention connector, comprising:

a pair of first and second connectors fittable to each other;

wherein the first connector includes:

a slider receivable in a slider receiving portion formed at an upper portion of a housing of the first connector, the slider comprising:

a resiliently-deformable bendable portion having an abutment portion formed at a distal end of the slider, and a contractible spring portion provided at a rear portion of the slider;

a push-up projection formed on an inner surface of the slider receiving portion so as to resiliently deform the bendable portion of the slider; and a cancellation operating portion which can be swingingly moved about one end of the portion housing so as to push up the abutment portion of the bendable, wherein the second connector includes a retaining portion provided at one end of a housing of the second connector, wherein when the second connector is fitted relative to the first connector, the retaining portion abuts against the abutment portion of the slider to compress the slider, and wherein when the two connectors are completely fitted together, the retaining portion is engaged in a retaining hole formed in the bendable portion.

2. A half-fitting prevention connector according to claim 1, wherein the slider includes a base plate, which is movable in accordance with the expansion and contraction of the spring portion, and has the retaining hole, and guide projections which are formed respectively on wall portions, formed respectively at opposite side edges of the base plate, so as to guide the movement of the base plate.

* * * * *